US006568824B2

(12) United States Patent
Jantz et al.

(10) Patent No.: US 6,568,824 B2
(45) Date of Patent: May 27, 2003

(54) ELECTRICALLY POWERED ELEMENT AND A BATTERY THEREFOR

(76) Inventors: Keith Charles Jantz, 512 Barnard Street, Williams Lake, British Columbia (CA), V2G 1G4; Steven Jantz, 2805-15th Street, Vernon, British Columbia (CA), V1T 3V7

( * ) Notice: Subject to any disclaimer, the term of this patent is extended or adjusted under 35 U.S.C. 154(b) by 221 days.

(21) Appl. No.: 09/789,618

(22) Filed: Feb. 22, 2001

(65) Prior Publication Data

US 2001/0033485 A1 Oct. 25, 2001

Related U.S. Application Data

(60) Provisional application No. 60/184,347, filed on Feb. 23, 2000.

(51) Int. Cl.[7] ..... F21W 131/30; F21Y 101/02

(52) U.S. Cl. ..... 362/104; 320/107

(58) Field of Search ..... 362/104, 571, 362/806, 800, 194, 195; 320/107, 112, 114; 429/96, 97, 98, 100; D13/103, 106

(56) References Cited

U.S. PATENT DOCUMENTS

| | | | | |
|---|---|---|---|---|
| 4,459,645 A | | 7/1984 | Glatter | 362/104 |
| 5,140,840 A | * | 8/1992 | Miceli | 362/571 |
| 5,253,149 A | * | 10/1993 | Ostema et al. | 362/104 |
| 5,504,664 A | * | 4/1996 | Ostema | 362/104 |
| 5,951,158 A | * | 9/1999 | Upah | 362/571 |

* cited by examiner

*Primary Examiner*—Laura K. Tso
(74) *Attorney, Agent, or Firm*—Adrian D. Battison; Michael R. Williams; Ryan W. Dupuis

(57) ABSTRACT

An illuminating earring or other electrically powered element includes a light-emitting diode (LED) encased within a synthetic gemstone. The LED/gemstone is permanently connected to a rigid coaxial conductor, forming a shaft dimensioned to pass through a hole in a pierced ear. A battery is adapted so as to allow the earring shaft to pass through the center of said battery, and dimensioned so that an electrical and mechanical connection take place when the battery is placed upon the shaft. The battery is also adapted so as to act as the clasp for the earring. Current flow between the LED and the battery takes place when the earring and battery are clasped together.

18 Claims, 3 Drawing Sheets

ELECTRICALLY POWERED ELEMENT AND A BATTERY THEREFOR

This application claims benefit of Provisional No. 60/184,347 filed Feb. 23, 2000.

This invention relates to an electrically powered element and a battery therefor which is particularly but not exclusively designed and arranged to provide an electrically powered earring which can readily be attached to the pierced ear of a wearer.

BACKGROUND OF THE INVENTION

There have been previous proposals to provide an illuminated earring which thus provides an attractive appearance on the ear of the wearer where the light source comprises a diode at the front mounting of a stud which inserts through the ear with a battery power source mounted at the end of the stud behind the ear lobe. An example of this arrangement is shown in U.S. Pat. No. 4,459,645 (Glatter) issued Jul. 10, 1984. This arrangement mounts a battery housing on the free end of the shaft and carries two batteries in the housing for the light source. This arrangement has the disadvantage that it is unable to provide a clamping effect of the housing of the battery against the ear lobe so that the battery housing can be spaced away from the rear of the ear lobe and the housing and the battery is relatively heavy thus tending to pull down the rear of the earring and interfere with the attractive appearance of the structure on the ear.

SUMMARY OF THE INVENTION

It is one object of the present invention, therefore, to provide an improved electrically powered earring.

It is a second object of the present invention to provide an improved mounting for a battery in combination with an electrically powered element powered by the battery.

According to one aspect of the invention there is provided an earring for a pierced ear, said earring comprising, in combination:

an electrically powered element, adapted to be worn and displayed on an outer face of the ear lobe of the ear, the electrically powered element having a positive and negative electrical connection for receiving an electrical current;

an elongate shaft mechanically and electrically connected at one end to said electrically powered element and adapted for an opposed free end to be passed through a pierced hole in the ear;

and a battery power source, adapted to be worn on and located behind said ear, and having an opening through the battery to receive the shaft therethrough, the battery defining a positive and a negative terminal arranged to directly electrically connect to first and second contact elements on the shaft for connection to the respective connections of the electrically powered element.

Preferably the shaft has portions thereof axially spaced thereon for directly contacting the terminals of the battery.

Preferably the battery carries a clasp for clamping onto the shaft.

Preferably the clasp is arranged on a side of the battery opposite to the ear lobe so as to press the battery directly against the rear face of the ear lobe and to clamp onto the free end portion of the shaft.

Preferably the opening in the battery is dimensioned to be a sliding fit on said shaft.

Preferably the cathode of said battery is attached to the earring clasp.

Preferably the current passes from the battery to the electrically powered element when the battery is slid onto the shaft and the anode of the battery comes in contact with the first contact of said shaft and the cathode/clasp comes in contact with the second contact of said shaft.

Preferably said electrically powered element comprises a light source or other powered elements such as small motors may also be provided for driving by the battery.

Preferably said light source includes a synthetic gemstone and a light-emitting diode (LED) arranged to illuminate the gemstone, either by placing the diode behind the gemstone or by encasing the diode within a gemstone.

Preferably the shaft includes a first piece which is a conductive tube dimensioned to fit through a pierced ear, forming the external coaxial conductor and having one end permanently connected to one terminal of said electrically powered element, a second piece which is a conductive rod portion longer than the first piece and having two ends, where one end is dimensioned to fit inside the first piece to form a center coaxial conductor, and is permanently connected to the other terminal of said electrically powered element with an opposite end extending beyond the first piece, and a third piece which is an insulating sleeve between the first and second pieces so as to isolate them electrically.

Preferably the second piece is dimensioned to have the same external radius as the first piece.

According to a second aspect of the invention there is provided a combination of a battery and an electrically powered element powered thereby comprising:

an electrically powered element having a positive and negative electrical connection for receiving an electrical current;

an elongate shaft mechanically and electrically connected at one end to said electrically powered element and extending therefrom;

and a battery power source having an opening through the battery to receive the shaft therethrough, the battery defining a positive and a negative terminal arranged to directly electrically connect to first and second contact elements on the shaft for connection to the respective connections of the electrically powered element.

BRIEF DESCRIPTION OF THE DRAWINGS

One embodiment of the invention will now be described in conjunction with the accompanying drawings in which.

DETAILED DESCRIPTION

Figure 1:
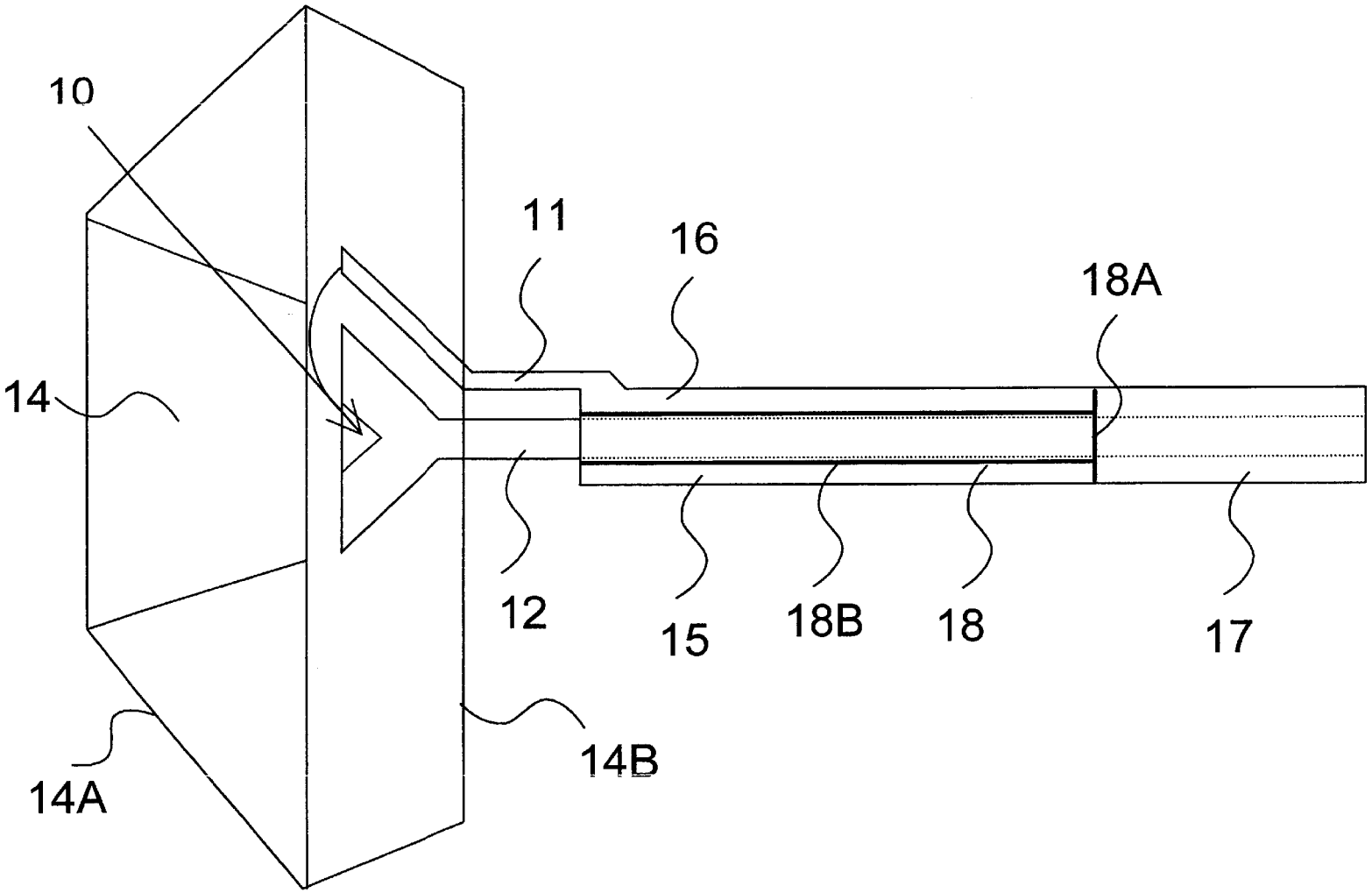
FIG. 1 is a side elevational view through a the light source and shaft of an earring according to the present invention.

In FIG. 1 is shown the structure of the first piece including a conventional LED. 10 which has positive and negative electrical connections 11, 12 respectively for receiving electrical current from a suitable battery source 13. The diode is embedded in an acrylic gem stone 14 so the diode faces into the interior of the gem stone so that light emits through the front face 14A of the gem stone to provide an attractive appearance. The acrylic material can be cast onto the diode in conventional manner.

The electrical connections 11, 12 pass through the rear 14B of the diode and the gem stone into an elongate shaft 15 which is formed in three pieces 16, 17 and 18. A first piece 16 which forms a positive connection piece or anode for connection to the positive connection 11 of the diode provides a first cylindrical portion along the length of the shaft 15. A second negative connection piece 17 or cathode for connection to the negative connection 12 of the diode is provided coaxial with the first and beyond the end of the first. A rod portion 19 of the connection piece 17 extends along the length of the shaft coaxially within the first sleeve portion 16 to the negative connection 12. An insulation sleeve 18 has an annular end piece 18A between the anode 16 and cathode 17 separating those and preventing any electrical interconnection. A cylindrical piece 18B of the insulation sleeve 18 is arranged inside the anode sleeve 16 and outside the rod portion 19 of the cathode so as to hold those elements separated electrically. Thus the anode 16 and cathode 17 form coaxial actually spaced pieces along the length of the shaft 15.

Figure 2:
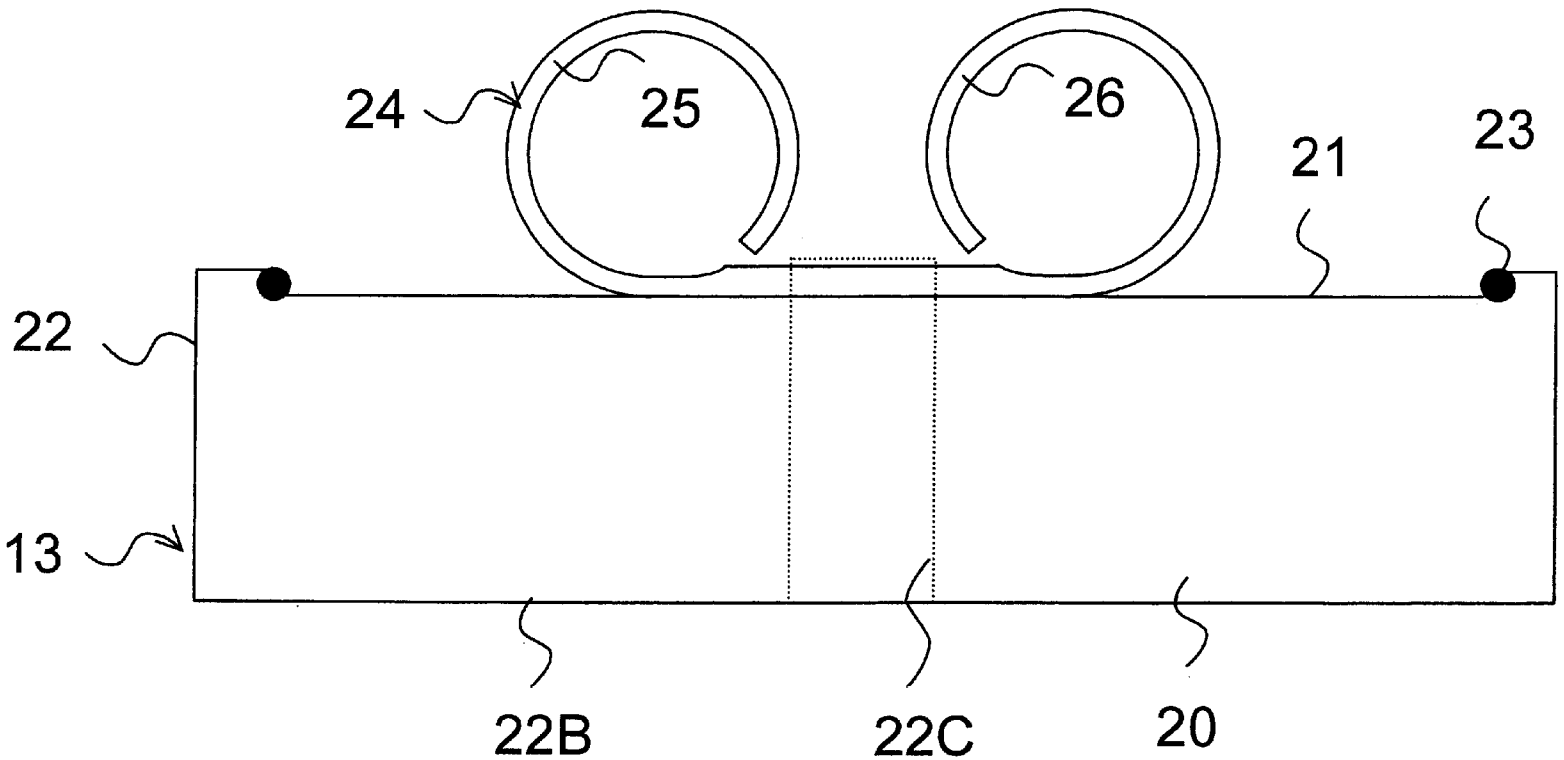
FIG. 2 is a side elevational view through a the battery and clasp of an earring according to the present invention.
Figure 3:
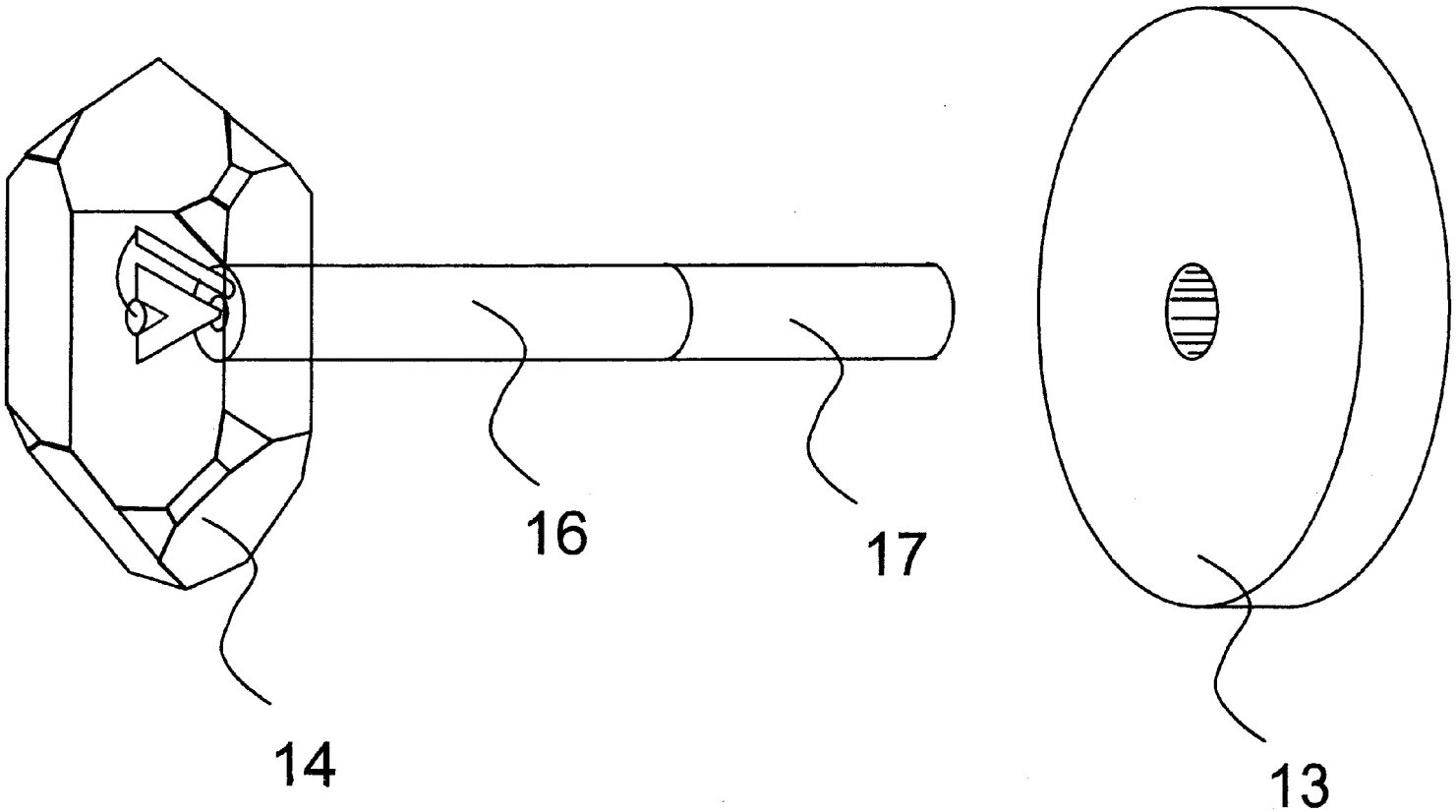
FIG. 3 is an isometric view of the two components of an earring according to the present invention.

The battery arrangement 13 is shown in FIGS. 2 and 3 and includes a battery casing 20 which forms directly the exterior of the battery itself. A flat face 21 at the rear of the battery forms the negative terminal of the battery and the remainder 22 of the casing including the front face 22B forms the positive terminal of the battery. They are separated by an insulation ring 23 at an interconnection between the end face and the cylindrical outer housing portion 22A. A clasp 24 of a conventional nature formed by two spring elements 25, 26 is attached to the rear negative face 21 of the battery and forms a clamping arrangement of a conventional construction for engaging onto the cathode portion 17 of the shaft 15. The battery has a central opening defined by a cylindrical wall 22C through the center, that is through the end walls 22B at the front forming a positive face. The front wall 22B and the interior wall 22C of the opening are therefore positive and engage onto the anode portion 16 of the shaft 15. The clasp and the rear face are negative and engage onto the end portion 17 of the shaft 15 which is the negative or cathode portion.

The battery 13 has no additional housing and directly mounts with its central hole on the shaft 15. The shaft is a sliding fit through the hole defined by the wall 22C. The length of the anode portion of the shaft is arranged so that it engages into the interior of the hole through the battery defined by the wall 22C and thus provides electrical connection with the positive terminal of the battery. The clasp and its negatively connected clamping element engages onto the cathode 17 or the negative portion of the shaft. The length of the shaft 15 and the length of the anode portion 16 are arranged so that most or average ear lobes can be clamped or squeezed between the front face 22B of the battery and the back 14B of the gem stone 14. The battery is thus held close up against the ear lobe so that it is not supported in cantilever arrangement spaced rearwardly from the ear lobe and thus avoids twisting or tilting of the ear ring. Also the battery is not increased in weight by any additional or unnecessary housing elements.

In FIG. 3, an isometric view is shown of the battery including its front face 22B and peripheral surface 22A, the shaft 15 and the gem stone 14 of the front end of the shaft.

The battery with a central hole can also be used for directly mounting on other shaft structures. It will be appreciated that this arrangement provides a very light construction avoiding necessity for additional and unnecessary housing elements so that the battery structure can be minimized and provide power to other elements and earrings using the shaft and hole mounting arrangement.

One aspect of the invention is therefore the provision of a battery with a central hole for receiving a shaft where the shaft directly provides the negative and positive terminals for attachment to the casing elements of the battery by direct connection.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. An earring for a pierced ear, said earring comprising, in combination:

an electrically powered element, adapted to be worn and displayed on an outer face of the ear lobe of the ear, the electrically powered element having a positive and negative electrical connection for receiving an electrical current;

an elongate shaft mechanically and electrically connected at one end to said electrically powered element and adapted for an opposed free end to be passed through a pierced hole in the ear;

and a battery power source, adapted to be worn on and located behind said ear, and having an opening through the battery to receive the shaft therethrough, the battery defining a positive and a negative terminal arranged to directly electrically connect to first and second contact elements on the shaft for connection to the respective connections of the electrically powered element.

2. The earring according to claim 1 wherein the shaft has portions thereof axially spaced thereon for directly contacting the terminals of the battery.

3. The earring according to claim 1 wherein the battery carries a clasp for clamping onto the shaft.

4. The earring according to claim 3 wherein the clasp is arranged on a side of the battery opposite to the ear lobe so as to press the battery directly against the rear face of the ear lobe and to clamp onto the free end portion of the shaft.

5. The earring according to claim 1 wherein the opening in the battery is dimensioned to be a sliding fit on said shaft.

6. The earring according to claim 3 wherein the cathode of said battery is attached to the earring clasp.

7. The earring according to claim 1 wherein the current passes from the battery to the electrically powered element when the battery is slid onto the shaft and the anode of the battery comes in contact with the first contact of said shaft and the cathode/clasp comes in contact with the second contact of said shaft.

8. The earring according to claim 1 wherein said electrically powered element comprises a light source.

9. The earring according to claim 8 wherein said light source includes a synthetic gemstone and a light-emitting diode (LED) arranged to illuminate the gemstone.

10. The earring according to claim 1 wherein the shaft includes a first piece which is a conductive tube dimensioned to fit through a pierced ear, forming the external coaxial conductor and having one end permanently connected to one terminal of said electrically powered element, a second piece which is a conductive rod portion longer than the first piece and having two ends, where one end is dimensioned to fit inside the first piece to form a center coaxial conductor, and is permanently connected to the other terminal of said electrically powered element with an opposite end extending beyond the first piece, and a third piece which is an insulating sleeve between the first and second pieces so as to isolate them electrically.

11. The earring according to claim 10 wherein the second piece is dimensioned to have the same external radius as the first piece.

12. A combination of a battery and an electrically powered element powered thereby comprising:

an electrically powered element having a positive and negative electrical connection for receiving an electrical current;

an elongate shaft mechanically and electrically connected at one end to said electrically powered element and extending therefrom;

and a battery power source having an opening through the battery to receive the shaft therethrough, the battery defining a positive and a negative terminal arranged to directly electrically connect to first and second contact elements on the shaft for connection to the respective connections of the electrically powered element.

13. The combination according to claim 12 wherein the shaft has portions thereof axially spaced thereon for directly contacting the terminals of the battery.

14. The combination according to claim 12 wherein the battery carries a clasp for clamping onto the shaft.

15. The combination according to claim 14 wherein the opening in the battery is dimensioned to be a sliding fit on said shaft.

16. The combination according to claim 14 wherein the cathode of said battery is attached to the clasp.

17. The combination according to claim 12 wherein the shaft includes a first piece which is a conductive tube forming the external coaxial conductor and having one end permanently connected to one terminal of said electrically powered element, a second piece which is a conductive rod portion longer than the first piece and having two ends, where one end is dimensioned to fit inside the first piece to form a center coaxial conductor, and is permanently connected to the other terminal of said electrically powered element with an opposite end extending beyond the first piece, and a third piece which is an insulating sleeve between the first and second pieces so as to isolate them electrically.

18. The combination according to claim 17 wherein the second piece is dimensioned to have the same external radius as the first piece.

* * * * *